United States Patent [19]

Richards et al.

[11] 4,317,162

[45] Feb. 23, 1982

[54] BATTERY OPERATED LUMINAIRE WITH EMERGENCY SWITCHING MEANS

[75] Inventors: Raymond R. Richards, Milton; John E. Gulliksen, Shrewsbury, both of Mass.

[73] Assignee: Koehler Manufacturing Co., Marlborough, Mass.

[21] Appl. No.: 146,351

[22] Filed: May 2, 1980

[51] Int. Cl.[3] ..... F21V 33/00

[52] U.S. Cl. ..... 362/106; 362/105; 362/183; 362/200

[58] Field of Search ..... 362/106, 105, 183, 200

[56] References Cited

U.S. PATENT DOCUMENTS 3,358,137 12/1967 Sinclair et al. ..... 362/183

4,231,079 10/1980 Heminover ..... 362/183

*Primary Examiner*—Stephen J. Lechert, Jr.

*Attorney, Agent, or Firm*—Hamilton, Brook, Smith & Reynolds

[57] ABSTRACT

A rechargeable storage battery and miner's cap lamp apparatus includes a headpiece and a cable member which connects the headpiece with the battery. The battery is constructed with a detachable top in which is mounted protectively housed switching means for actuating a plurality of rechargeable cell groups contained in the battery. Typically two lead-acid cells may be provided in the battery and connected in series to provide a four volt output in a conveniently portable sized unit for miner's use.

In the battery and detachable top construction, the rechargeable battery cell groups are further provided with positive and negative charging terminals located on and extending through the battery top, for example at opposite sides thereof, in a position to connect with suitable charging rack apparatus which avoids charging the battery through the headpiece. At points inside a limited space defined in the battery top and located in close proximity to the positive and negative charging terminals is further provided circuitry which is responsive to movement of the protectively housed switching means. The switching means is of uniquely constructed nature and is operable from points located externally of the battery top.

In one position the switching means closes a circuit for operating the cell groups in series and simultaneously provides for completing a charging circuit in which a charging current may be conducted through the series arrangement. In this position of the switching means, the lamp means operated through the series cell group arrangement provides a relatively high intensity of light. In a second position of the switching means the cell groups are connected in parallel and simultaneously the charging circuit is disconnected. In this parallelly connected position of the switch the lamp means operates at a lowered intensity of light. Operation of the battery at a lower light intensity level substantially increases the period during which the battery powered cap lamp may be effectively used and there may be realized an increased emergency lighting capability for a miner trapped, for example, behind a roof fall.

13 Claims, 11 Drawing Figures

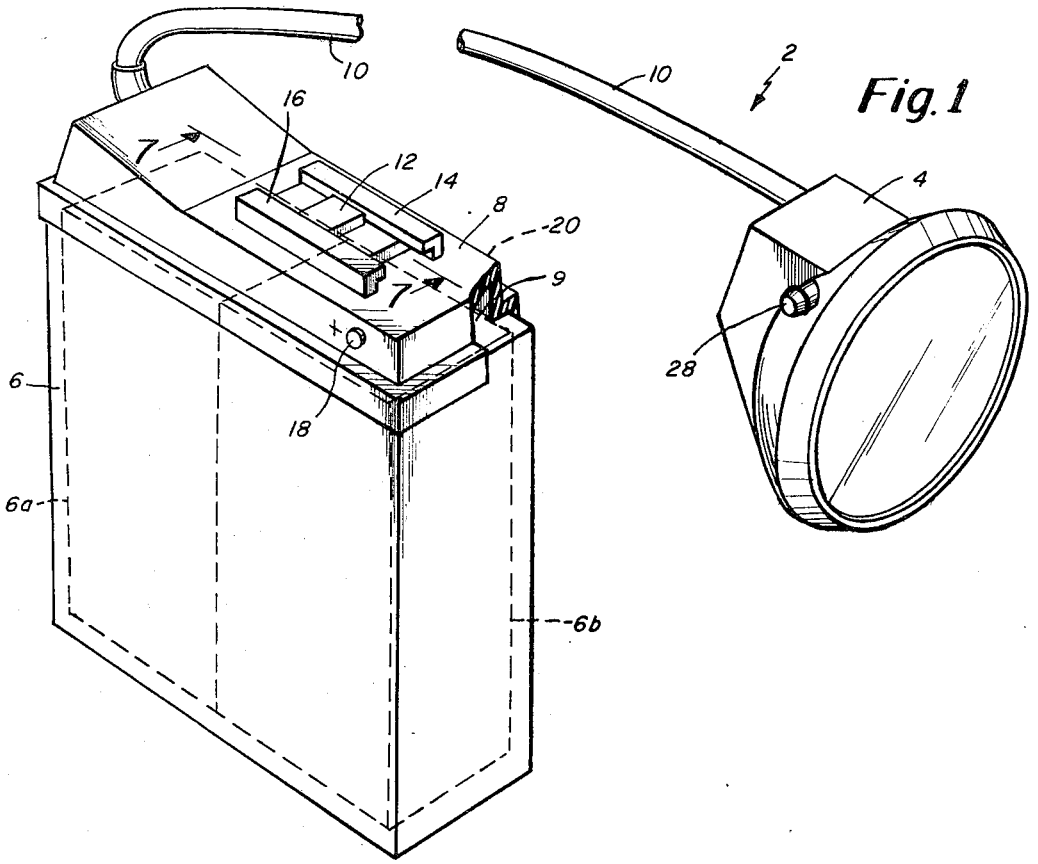
Fig. 1
Fig. 2
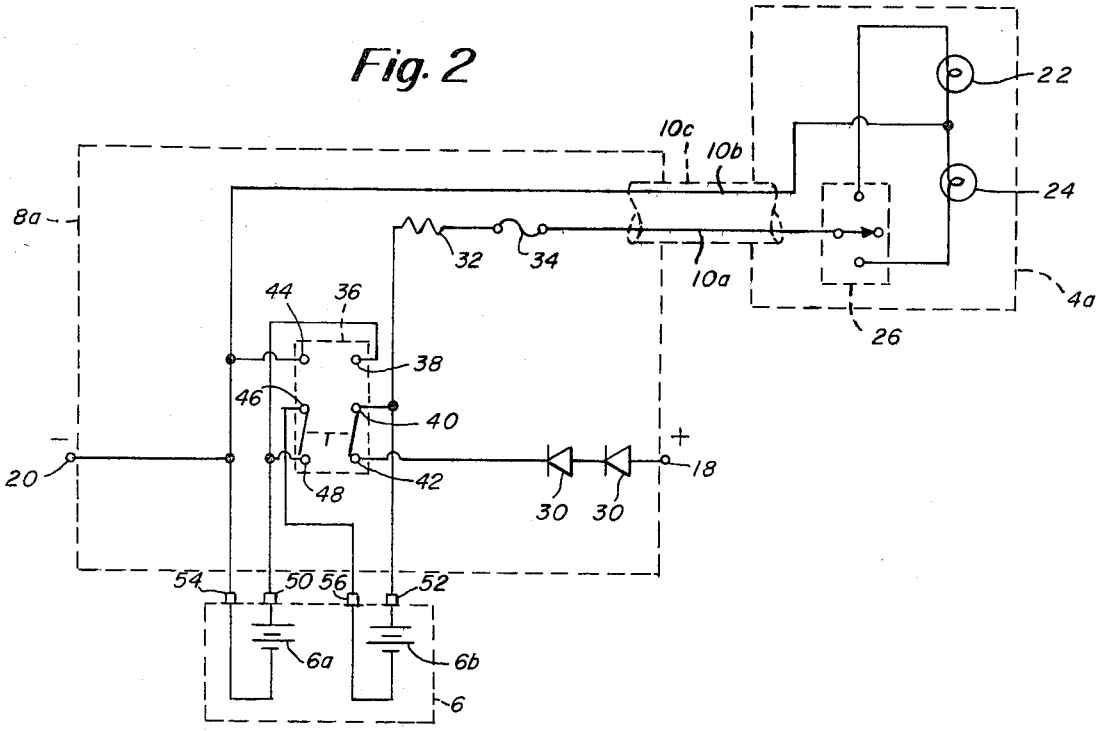

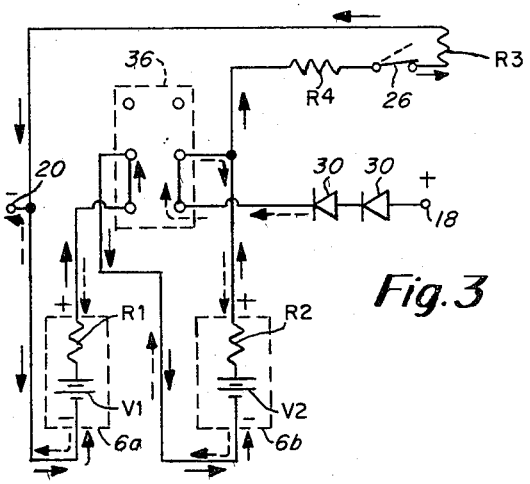
Fig. 3
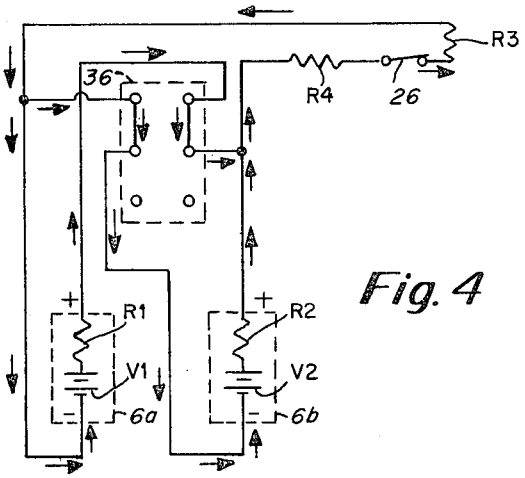
Fig. 4
Fig. 5
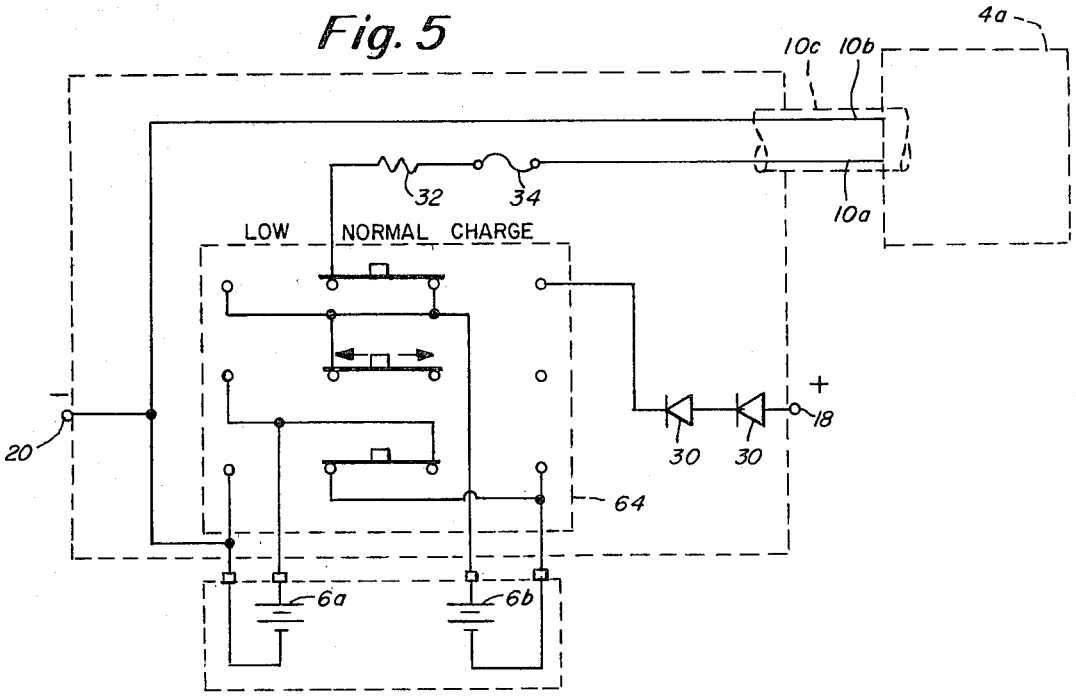

BATTERY OPERATED LUMINAIRE WITH EMERGENCY SWITCHING MEANS

BACKGROUND OF THE INVENTION

It is customary in miners' cap lamps to provide a backup source of light in addition to the primary source of light used by the miner in the performance of his duties. This backup source may take the form of a second bulb, where the primary source is a bulb of single-filament construction, or of a second filament in the same bulb envelope as a primary filament. In either case it is desirable that the backup source may be used for the performance of normal duties should the primary light source or filament fail.

Certain countries specify that the wattage of the backup light source, as determined by its current draw, be substantially less than that of the primary source. As an example, a primary source may have a 4.8 watt filament, and a secondary source a 3.2 watt filament. In this case, should the miner be trapped, he will switch to the secondary source, thereby prolonging the duration of available light at the expense of intensity. This approach carries the disadvantage of reduced light output and thus reduced visibility for the miner under normal working conditions should the primary source fail.

A second approach, which has not met with significant acceptance, involves switching a resistance element into and out of series connection with either the primary or the secondary filament. Although this produces the desired battery conservation effect, it is not efficient in terms of conversion of battery power to light since some of the power available from the battery is consumed and dissipated as heat by the resistance element.

A third approach is to provide switching means for connecting the two filaments in series, and operating the lamp in this mode in an emergency situation. This approach carries the disadvantage of reliance upon the integrity of both filaments; should one fail, the miner no longer has recourse to low light intensity operation.

Any system which is to be used in a mining application must also meet certain physical and safety requirements, e.g. the miner must never be allowed access to any live electrical conductors, any switch means must be protected against physical damage, and any entry point into the lamp structure must be adequately sealed against entry of water and dust.

To date, no proposed system has successfully dealt with the problems as described above in an effective and efficient manner.

SUMMARY OF THE INVENTION

The present invention relates to a miner's cap lamp apparatus including a headpiece which may contain dual light sources and a cable connecting the headpiece with a rechargeable storage battery. A switch in the headpiece operates to selectively energize the light sources when desired.

The rechargeable battery is provided with cell groups which are arranged to normally operate in series and provide a full light intensity when a light source is energized. The battery is provided with a detachable top, on opposite sides of which are charging contacts which are readily connected with suitable charging apparatus. Usually the battery will be charged when the cell groups are connected in a series mode.

It is a chief object of the invention to combine with the lamp apparatus described electrical means and switch means for controlling the electrical means to provide for alternatively operating the lamp apparatus in a low light intensity mode by connecting the battery cell groups in parallel.

Another object of the invention is to devise an arrangement of protectively housed switch means and circuitry confined in a detachable battery top to operate the lamp apparatus alternatively in the series and parallel modes described above without in any way compromising the normal operation of the cap lamp and to prevent flow of charging current through the parallelly disposed cell groups.

Another object of the invention is to devise electrical means which includes a selective switching means capable of being located in the detachable battery top of a battery consisting, for example, of two lead-acid cells which provide a four volt operation when connected in series. It is intended that the electrical means be such that, when the cell groups are operated in parallel, the light intensity does not fall below a level of acceptable functionality.

Still another object of the invention is to devise a protectively housed switching means which is resistant to damage from impact forces when used in various forms of electrically operated devices and which, in addition, is especially useful in miner's cap lamp apparatus in providing that a miner can have no access to live electrical conductors and which precludes entry of damaging water, dust or other foreign material when the said apparatus is carried by a miner.

It has been found that the foregoing objectives may be achieved, for example, by means of a lead-acid storage battery and miner's cap lamp apparatus characterized by a special arrangement of parts as noted below.

Included in the special arrangement of parts is a battery comprising two cell groups, each group having an equal number of cells. This battery may be, for example, a four volt lead-acid miner's battery constructed with a detachable top which defines an inner space of limited extent. Mounted in the detachable top and extending into the inner space is protectively housed switching means and electrical circuitry for actuating a plurality of rechargeable cell groups. Positive and negative charging terminals are located on and extend through the battery top in positions to connect with suitable battery charging rack apparatus. It will be noted that the arrangement as designed avoids charging the battery through the headpiece and cable (as is the common practice).

The electrical circuitry secured inside the battery top is responsive to movement of the protectively housed switching means into either one of two positions of adjustment. Movement of the protectively housed switching means into either of the positions of adjustment is carried out manually, externally of the battery top.

In one position of adjustment, the battery cell groups are connected in series and a normal intensity of light is produced. When the switching means is moved into a second position of adjustment, the battery cell groups are connected in parallel and, simultaneously, the charging circuit is disconnected. In this parallelly connected position a lowered intensity of light is produced as hereinafter described in detail. Operation of the lamp apparatus at a lessened light intensity level substantially increases the period during which the battery may be practically used to operate the cap lamp. Thus there may be realized an increased emergency lighting capability for a miner trapped, for example, behind a roof fall. It will be apparent that a miner, recognizing the importance of this emergency lighting capability, may significantly conserve such capability by connecting the cell groups in the parallel mode when full light intensity operation is not essential.

In utilizing the connected cells in a parallel mode to provide a reduced light intensity, the circuitry disclosed in detail in the drawings and specification is chosen such that light intensity is not reduced below a level of acceptable functionality. As hereinafter disclosed in the specification, it has been found that an acceptable ratio of current provided to lamp apparatus during parallel operation to the current provided during series operation is in the range of 0.7 to 0.9 and, expressed in terms of wattage, the ratio may be in a range of 0.36 to 0.45.

In controlling battery operation in the manner disclosed an important feature of the invention is a uniquely designed slide switch means for operating circuitry contained, for example, in a limited space in a detachable battery top. An essential improvement in the apparatus described is that the slide switch means is constructed so as to present an externally located auxiliary actuator part such that the switch itself, lying under and extending through the battery top, is completely shielded from accidental shock or impact forces and is also sealed against entry of moisture or other foreign material. Details of the switch means are hereinafter disclosed more fully.

BRIEF DESCRIPTION OF THE DRAWINGS

FIG. 1 is a perspective view illustrating a miner's cap lamp of the class described having switching means of the invention.

FIG. 2 is a circuit diagram showing, in electrical schematic form, the apparatus of FIG. 1.

FIG. 3 is a circuit diagram showing, in electrical schematic form, the operation of the lamp of FIG. 1 in a normal mode, i.e. series.

FIG. 4 is another circuit diagram similar to FIG. 3 but showing operation in a low power, i.e. parallel mode.

FIG. 5 is a circuit diagram similar to that of FIG. 2 but showing one modification of switching means to provide an OFF/CHARGE position.

DETAILED DESCRIPTION OF THE INVENTION

Figure 6:
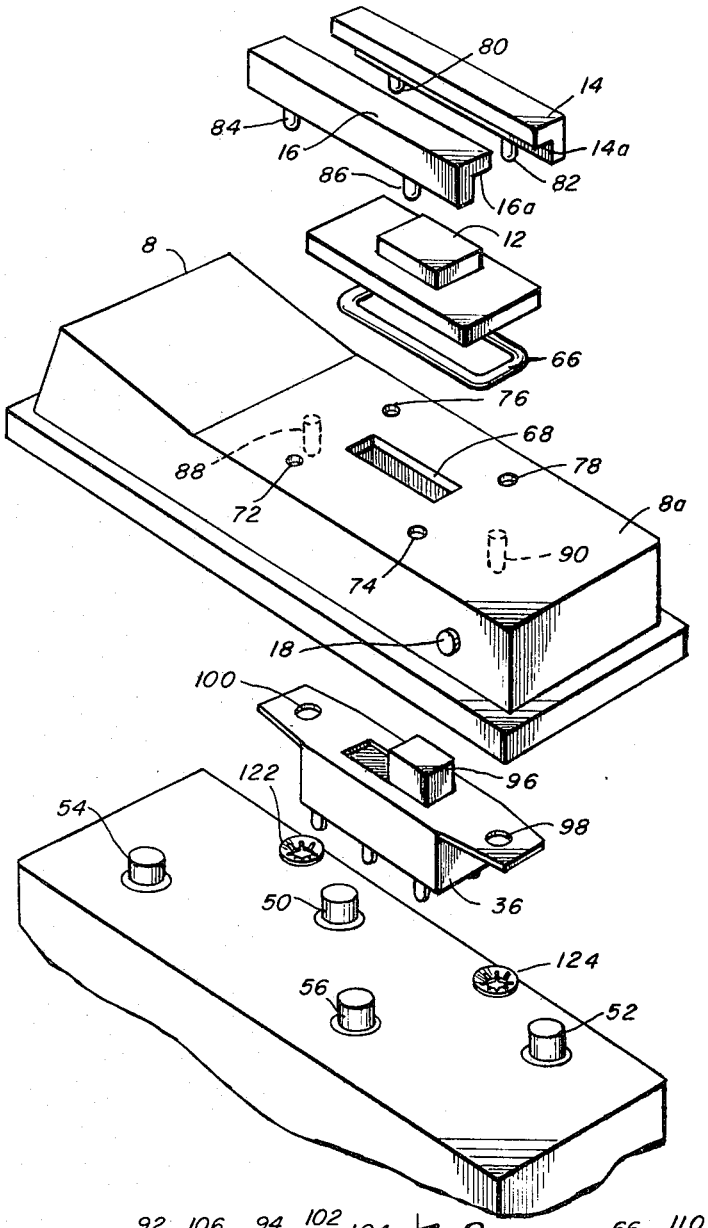
FIG. 6 is a perspective view showing the component parts of a switching means of the invention in exploded form.

The apparatus of this invention in general presents several inventive aspects which may be directed to equipment of various types involving a switch controlled assembly of parts. Improvements are present in the parts themselves, the association of the parts with one another and in the switching means by which the desired objectives may be realized.

In the Abstract of the Invention reference has earlier been made to a miner's cap lamp apparatus and the invention features will be set forth below with particular regard to a four volt battery having two rechargeable cell groups comprising one two volt lead-acid cell, and its use in providing a light source for use in a mine. However, inventive features disclosed are not intended to be limited to this apparatus.

Referring more in detail to the drawings, FIG. 1 illustrates a miner's cap lamp apparatus, generally denoted by arrow 2, including a headpiece 4 having two incandescent light sources numerals 22 and 24 (FIG. 2), a battery 6 and a cable 10 for connecting the headpiece with the battery. The headpiece differs from conventional forms of such devices in that no provision is made for conducting a charging current therethrough. Headpiece light sources may be selectively energized by the battery through a bulb selector switch having an actuator knob 28, as shown in FIG. 1.

The battery 6 comprises a housing body in which are received rechargeable cell groups as **6*a* and 6*b*. At its upper side the battery 6 is provided with a detachable battery top 8, the upper side of which lies in spaced relation above the top of the battery to define a space 9 of limited extent. An opposite end of the battery top 8 is enlarged to provide an entrance for the relatively heavy cable 10**. It will be understood that the detachable battery top may be secured by various means such as screws, clamps, etc.

Located at an intermediate portion of the battery top 8 is a switching assembly, certain components of which are externally mounted on the battery top and another component of which extends downwardly into the space 9 of limited extent noted above and forms a part of electrical circuit means, further illustrated schematically in FIGS. 2, 3 and 4.

The battery top 8 together with the attached battery 6 is designed to be placed directly in a battery charging rack to provide for charging of cells **6*a* and 6*b* and the battery top 8 includes positive battery charging terminal 18 and negative charging terminal 20 located on and through the battery top as shown in FIG. 1**. This takes the place of conventional charging through a cap lamp headpiece.

It will be observed that the battery, its newly designed battery top 8, having a space 9 which includes electrical circuit means, together with a controlling switch for the electrical circuit means, as well as the charging terminals 18 and 20 disclosed, constitute a novel assembly of parts which can be used to control operation of the battery by a miner in various ways depending upon whether the lamp means is to be energized at all, energized at a maximum level, or energized at some relatively lower level of light intensity.

A highly important feature of the invention is the concept of providing circuit means as described which can control the level of light intensity, which may be varied as desired, subject to different conditions in a mining operation. This concept is based upon operating the battery cells in series in one mode and in parallel in another mode whereby the intensity of light provided may be appreciably lowered in the parallel mode to a level which extends the emergency capability of the battery on discharge. Since the value of emergency lighting capability is fully recognized by a miner, means in the form of switching apparatus, to be described in detail below, allows a miner to conserve battery capacity by not utilizing high intensity lighting when it is not necessary.

In accordance with the invention there has been designed electrical circuit means by which the invention concept of changing high intensity lighting to a practical level of low intensity lighting may be quickly and conveniently carried out by a miner by a simple manual adjustment of switching means located on the battery top 8.

One such electrical means located in the battery top, as noted above, is illustrated schematically in FIGS. 2, 3 and 4.

As shown in FIG. 2, numeral 36 refers to switch means, which is shown in broken lines and is of double-pole, double-throw nature, and which includes six terminals 38, 40, 42, 44, 46 and 48. In one position, terminals 38 and 40 are connected together, as are terminals 44 and 46, while in the other position contact is made between terminals 40 and 42 as well as between terminals 46 and 48.

The first position described above is a parallel cell group connection providing a low lighting intensity mode, while the second position described is a series cell group connection providing a normal lighting intensity mode.

Terminal 38 of switch means 36 is electrically connected by means of lead wires to switch terminal 48, as well as to positive terminal 50 of cell group 6*a*. Terminal 40 is connected to the positive terminal 52 of cell group 6*b* and is also connected through resistance element 32, circuit protection means 34 and conductor 10*a* to elements contained within the headpiece assembly 4*a*.

Terminal 42 is connected through blocking diodes as 30 to positive charging terminal 18. Terminal 44 is connected to negative terminal 54 of cell group 6*a* and also, through conductor 10*b*, to elements contained within the headpiece assembly 4*a*. Terminal 46 is connected to negative terminal 56 of cell group 6*b*.

FIG. 3 illustrates the circuit of FIG. 2 as if hardwired, i.e. with the moveable portion of switch means 36 replaced by wires, in the series mode, and this Figure further shows cell groups 6*a* and 6*b* in simplified equivalent circuit form. Each equivalent circuit, as shown, includes voltage sources V1 and V2 respectively, and series resistance components R1 and R2 respectively, representing the internal resistance of the cell groups 6*a* and 6*b*. Headpiece assembly 4*a* and its associated components are represented by an equivalent load resistance R3; resistance element 32 and circuit protection means 34 are represented by a lumped resistance R4.

It will be seen that, in this mode of battery cell operation, charging current as illustrated by dashed arrows can flow through diodes as 30 and then through cell groups 6*a* and 6*b*, which are connected in series with one another, with negative terminal 56 of cell group 6*b* connected to positive terminal 50 of cell group 6*a* (see FIG. 2). Discharge current, as represented by solid arrows, flows through the load R3 from series connected cell groups as shown. It will be noted that the total internal resistance of the battery 6 may be considered as the sum of the two series resistance components R1 and R2.

FIG. 4 illustrates the circuit of FIG. 2 as if hardwired in the low light intensity (i.e. parallel) mode with simplified equivalent circuits etc. as in FIG. 3. It will be noted that current cannot flow to either cell troup 6*a* or 6*b* from positive charging terminal 18 since this terminal and its associated blocking diodes 30 have been disconnected. It will be noted that the cell groups 6*a* and 6*b* are now connected in parallel with one another, with positive terminals 50 and 52 (FIG. 2) connected together and negative terminals 54 and 56 also connected together. Discharge current, as indicated by solid arrows, flows from both cell groups through the load R3 as shown.

Originally it was assumed that providing electrical circuit means in a battery top by which the level of intensity of lighting might be varied by means of a switch received in the battery top to change the connection of the cell groups from series to parallel mode, thus reducing the voltage by a factor of 2, would result in current also being reduced by a factor of 2. This would be assumed from Ohm's Law, $E=I/R$, where E represents voltage, I represents current and R represents resistance, as in the following:

$$I=E/2R,$$

assuming that R remains constant.

However, it has been determined that should both current and voltage be reduced by a factor of 2, the resulting light may be of too low intensity to be of any practical use to a miner. Therefore, it has been found that the electrical circuit must comprise means, including lamp means, by which the current delivered to the lamp means during parallel operation is established at a value appreciably exceeding one half of the current delivered to the lamp means by the cell groups during series operation. Satisfactory current values have been obtained, for example, by circuit means as disclosed below.

In the equivalent circuit of FIG. 3 (series mode) total resistance is $R_S=R1+R2+R3+R4$, while in the equivalent circuit of FIG. 4 (parallel mode) $R_P=(R1\times R2)/(R1+R2)+R3+R4$. Assuming that $R1=R2$, the current equation for the normal (or series) mode may be restated as follows: $I_S=E/(2R1+R3+R4)$, in which E represents the voltage of the cell groups connected in series, and the current equation for the parallel mode may be restated as $I_P=(E/2)/(R1/2+R3+R4)$ for the same value of E.

Thus, current drawn by the load in the parallel mode will be greater than one-half of the current drawn by the load in the series mode. For example, in a battery comprising two lead-acid calles, each of two volts, combined with an incandescent light source rated at 1.2 amperes at four volts, it has been determined that current drawn by the lamp means in the low intensity mode will be approximately 0.95 amperes.

This result is due to the mathematical evaluation described above, as well as to the fact that an incandescent filament will have a higher resistance at higher temperatures. Reducing the voltage to the filament will also reduce its temperature and thereby its electrical resistance, thus allowing it to draw more current.

Experimental results have shown that the ratio of current drawn by an incandescent lamp load connected to two lead-acid cells in series to the current drawn by the same incandescent lamp load connected to two lead-acid cells in parallel will be in the range of 0.7 to 0.9; this ratio, specified in terms of wattage, will be in the range of 0.35 to 0.45. This level of light intensity is sufficient to allow a trapped miner to perform the majority of tasks which may be required of him in such a situation as well as providing him with a significant psychological benefit.

As will be appreciated by those familiar with the battery art, the capacity of a battery cell is customarily rated in terms of ampere-hours. This rating is unchanged when cells are arranged in series; such a series arrangement increases available voltage capacity in watt-hours may be calculated by multiplying voltage by ampere-hour capacity. As an example, if two 14 ampere-hour lead-acid cells were arranged in series, the available watt-hours would be:

$$\text{Capacity} = 4 \text{ volts} \times 14 \text{ ampere-hours} = 56 \text{ watt-hours.}$$

The ampere-hour rating will customarily increase to some extent should the rate of current drawn on discharge be reduced, depending upon the electrochemical design of the cells. For purposes of this disclosure, however, the ampere-hour capacity of the cells shall be assumed to remain constant.

When a 4.8 watt filament is employed, the usable discharge duration from such a series arrangement may be calculated as $$\text{Capacity } (WH)/\text{Filament } (W) = 56/4.8 = 11.67 \text{ hours.}$$

When the cells are switched into parallel arrangement as previously disclosed, the voltage available will be reduced by a factor of two, while the ampere-hour capacity of the battery will be doubled, thus the watt-hour capacity will remain relatively unchanged at 56 watt-hours.

Experimental data indicates that a nominally-rated 4.8 watt-at-4-volts filament will draw approximately 0.95 amperes at 2 volts, or 1.9 watts. Usable discharge duration may then be expressed as $$\text{Capacity } (WH)/\text{Filament } (W) = 56/1.9 = 29.47 \text{ hours,}$$

thus usable discharge duration has been increased by a factor of 2.5. In actuality, due to the fact that the ampere-hour capacity is somewhat increased by a reduction in current drawn, the discharge duration will be somewhat greater, perhaps three times the normal.

It may be desired in some cases to provide a switching means which allows for a third position, one in which charging is permitted but in which the load is disconnected, and to preclude charging in any other position. Such a circuit, employing a triple-pole, triple-throw slide switch 64, is shown in FIG. 5. Obviously, other circuit configurations including, for example, charging with cells connected in parallel, are possible.

The circuitry disclosed as in FIGS. 2 and 5 is intended to be illustrative of other possible circuitry such as one in which charging is carried out with cell groups connected in parallel, but the arrangements of FIGS. 2 and 5 are of a practical and simplified nature and lend themselves to use with a slide switch which use is preferable from a dimensional standpoint. Reference is made to the use of a slide switch as shown in the drawings.

Utilization of a slide switch, however, may present some pitfalls in mining applications. Firstly, a slide switch may be prone to accidental switching should the miner's hand or a piece of equipment come in contact with the actuator. Secondly, the switch must be protected against mechanical damage from impact, and, thirdly, the switch must be adequately sealed so that dust and potentially corrosive moisture are excluded from the housing in which the switch has been mounted. The most common mode of failure of a slide switch is, in fact, mechanical damage due to an impact upon the actuator. Commonly, slide switches are constructed with a thin metal housing enclosing two sides and the top, a plastic actuator protruding through a hole in the top of the metal housing, the body of which actuator is enclosed by the metal housing, and a piece of insulating fiberboard or similar material bearing the switch terminals attached to the lower portion of the switch by projections depending from the sides of the metal housing which are clinched around the fiberboard piece. A blow delivered vertically upon the protruding portion of the plastic actuator has the effect of forcing the plastic actuator down upon the fiberboard piece, either breaking same or loosening the clinched fastening.

Figure 7:
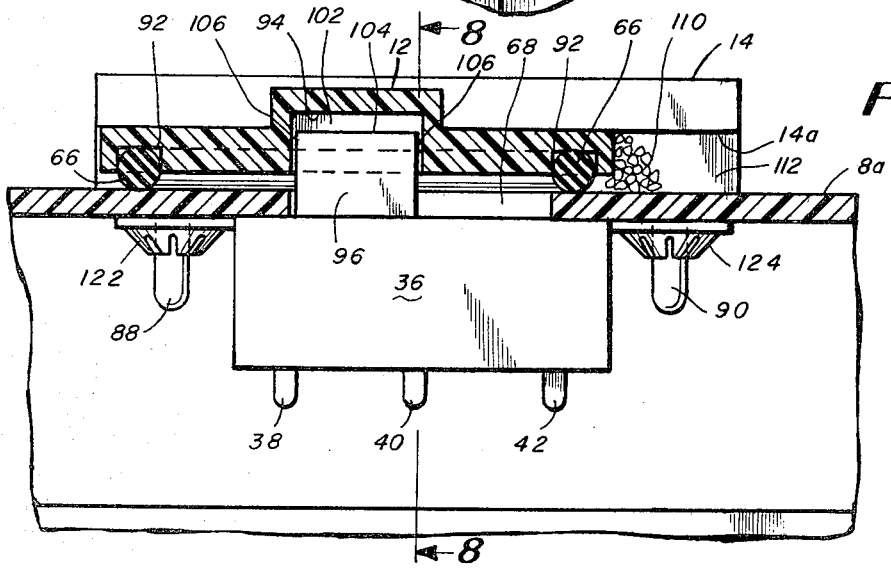
FIG. 7 is a fragmentary detail view showing certain of the component parts of the switching means of the invention in assembled form.

The present invention includes means for substantially eliminating these difficulties. FIG. 6 illustrates component parts of the mode selector switching means and battery top means of the invention in exploded form; FIG. 7 illustrates these components as assembled.

Referring to FIG. 6, numeral 8 denotes the battery top means of FIG. 1, numerals 14 and 16 designate guide rail portions as illustrated in FIG. 1. Numeral 12 designates the auxiliary actuator means of FIG. 1, and numeral 36 designates the switching means of FIG. 2. In addition, sealing means 66 is shown.

Battery top means 8 is provided with a rectangular hole 68 and may also be provided with round holes 72, 74, 76 and 78, said round holes being provided to receive depending parts 80, 82, 84, and 86 of guide rail portions 14 and 16. Battery top means 8 may also be provided with depending portions 88 and 90 on an inner surface thereof. Auxiliary actuator means 12 may also be provided on an under side thereof with a substantially annular channel 92 (FIGS. 7 and 8) in which sealing means 66 is to be received, and is also provided with a recess, a portion of which is denoted by numeral 102.

It will be noted at this point that battery top means 8 and guide rail means 14 and 16 may be fabricated from plastic materials which are selected so as to be easily bonded to one another; such bonding may be produced by cementing, solvent cementing, ultrasonic welding, etc. As an alternative, guide rail portions 14 and 16 may also be formed integrally with battery top means 8.

In the embodiment shown, a first step of assembly comprises assembling and bonding guide rail portions 14 and 16 to battery top means 8. Depending parts 80 and 82 of guide rail portion 14 are received in holes 76 and 78 respectively; depending parts 84 and 86 of guide rail portion 16 are received in holes 72 and 74 respectively. In this way, guide rail portions 14 and 16 are precisely located on battery top means 8 with respect to rectangular hole 68.

Figure 8:
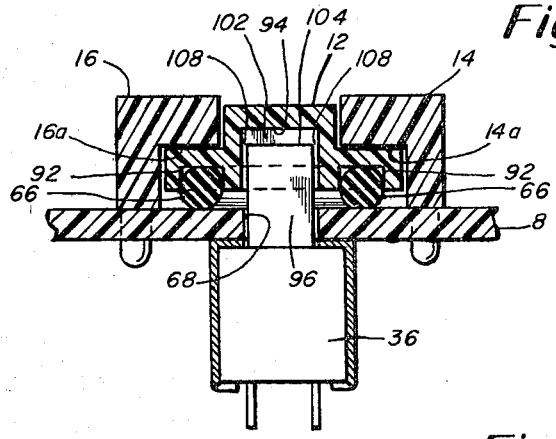
FIG. 8 is a view similar to FIG. 7, but rotated 90 degrees.

Sealing means 66 is then assembled to auxiliary actuator means 12 by placing same into channel 92. In FIGS. 6–8 sealing means 66 comprises an O-ring stretched to conform to the configuration of channel 92; other forms of sealing means such as a gasket may be employed in a similar manner.

Auxiliary actuator means 12 is then placed on surface 8*a* of battery top means 8 and pressed down so that sealing means 66 is in a compressed state. In this condition, auxiliary actuator means 12 is then slid between guide rail portions 14 and 16 such that it is held in place by surfaces 14*a* and 16*a* of guide rail portions 14 and 16 respectively, as may be seen more clearly in FIG. 8. Dimensional relationships are chosen such that sealing means 66 is maintained in a compressed state, as suggested in FIG. 8, while still allowing a sliding motion of auxiliary actuator means 12 between the guide rail portions.

Switch means 36 is then attached to the under side 8*b* of battery top means 8 in some conventional manner such that actuator 96 of switch means 36 extends through rectangular hole 68 and is received into the recess in auxiliary actuator means 12, as is more clearly shown in FIG. 7.

Attachment of switch means 36 to battery top means 8 may be accomplished, for example, by providing battery top means 8 with depending portions 88 and 90 as shown in FIG. 7. These depending portions are of such dimension and location that they may be received through holes 98 and 100 of switch means 36 to locate same in a proper position. Metal retainers 122 and 124 may then be pressed over depending portions 88 and 90 respectively to hold the switch in place.

Note that the manner of attachment of switch means 36 to battery top means 8 may be accomplished in a variety of ways; the only requirements are: (1) that no portion of any fastening means used protrudes above surface 8*a* of battery top means 8, (2) that any holes through battery top means 8 are adequately sealed, and (3) that the switch means 36 will be at least loosely held in place. Tight or snug attachment is desirable, but not absolutely necessary.

The switch means may be attached either in a wired or in an unwired state.

A necessary part of the invention is the providing of a clearance space 102 (FIG. 7) between the top surface 104 of the switch actuator 96 and inner surface 94 of auxiliary actuator means 12. With this arrangement a blow delivered to the top of auxiliary actuator means 12 will have its force transmitted to battery top means 8 via sealing means 66. Such forces will not be delivered to actuator 96 of switch means 36, and thus the switch means 36 is effectively protected from damage. Note that other clearance spaces as 106 (FIG. 7) and as 108 (FIG. 8) may also be provided.

Examination of FIG. 7 will also show that guide rail portions 14 and 16 extend at least flush with or above auxiliary actuator means 12, thus insuring that operation of switch means 36 must be intentional.

Examination of FIG. 7 will further show that dust or foreign matter as 110 will be pushed out of slideways as 112 by movement of the auxiliary actuator means 12. Sealing means 66, being maintained in a compressed state, will exclude fluid or particulate matter from access to rectangular hole 68. Confinement of sealing means 66 in channel 92 insures that sealing means 66 will travel with the motion of auxiliary actuator means 12.

It is pointed out that a small toggle switch may be substituted for the slide switch illustrated; protection may be achieved in a virtually identical manner.

Figure 9:
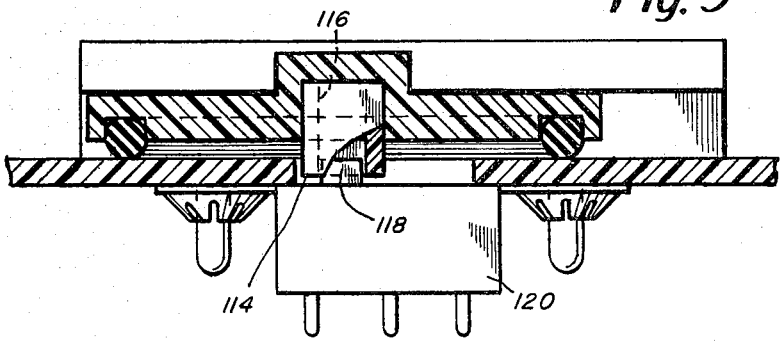
FIG. 9 is a view similar to FIG. 7, but showing one modification of certain of the components.

Dimensional considerations may require the use of a miniature slide switch of such dimension that its actuator may not extend sufficiently far through battery top means 8 to provide reliable operation. In such a case an additional part, such as is illustrated in FIG. 9, be required. It will be noted that there is only one additional part, an actuator extender 114.

Actuator extender 114 is of such dimension that it may be pressed snugly into recessed portion 94 of auxiliary actuator means 12. Actuator extender 114 is also provided with a recessed portion 116 (which may be a through hole as shown) in which actuator 118 of miniature switch 120 may be received. Actuator extender 114 is sufficiently long as to partially extend through rectangular hole 68 without actually coming into contact with upper surfaces 121 of miniature switch 120. The component parts are shown, assembled and in partial cross-section, in FIG. 9. Note that certain of the component parts may be of smaller size to correspond with the size of the switch.

Figure 10:
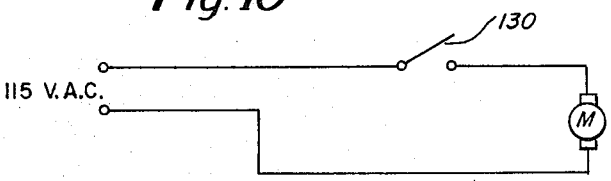
FIG. 10 is a view illustrating diagrammatically another form of switch circuitry of the invention.

As earlier noted, the components of the slide switch of the invention may be desirably combined with other forms of electrical circuitry not necessarily limited to a cap lamp or any other specific type of electrically operated device. Thus, for example, in FIG. 10 a motor M may be connected via single-pole, single-throw switch 130 to a 115 volt A.C. line power source.

Figure 11:
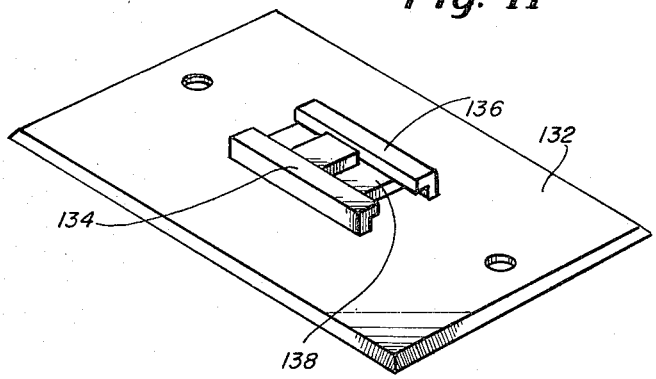
FIG. 11 is a perspective view illustrating another application of the switch means of the invention on a mounting plate.

FIG. 11 illustrates certain components of a protected switch housing of the invention assembled on a mounting plate 132. Guide rail portions, similar to rails denoted by numerals 14 and 16 of preceding Figures, are indicated by the numerals 134, 136. Auxiliary actuator part 138 is similar to that denoted by numeral 12 in preceding Figures. It is intended that the slide switch apparatus of the invention may be applicable to various other arrangements.

We claim:

1. A lead-acid battery and cap lamp apparatus, said apparatus comprising a headpiece, a battery and a cable for connecting the headpiece to the battery through a manually operated switch in the headpiece to selectively energize incandescent lamp means therein, said battery containing rechargeable cell groups of equal voltage and at its upper side presenting a detachable battery top occurring in spaced relation above the rechargeable cell groups to define a space of limited extent, adjustable switching means mounted in the battery top and extending into the said space, electrical circuit means including electrical contacts engageable by the siwtching means in one position of adjustment thereof to provide for operating the cell groups in series, said adjustable switching means being movable into engagement with additional contact means in the said electrical circuit means such that the cell groups are operated in parallel to energize the lamp means at a relatively lower level of light intensity than the intensity of the lamp means when the cell groups are operated in series, said electrical circuit means further including means for supplying current to the lamp means by the cell groups during parallel operation at a value greater than the value of the current supplied to the lamp means by the cell groups during series operation divided by the number of cell groups.

2. A lead-acid acid battery and miner's cap lamp apparatus, said apparatus comprising a headpiece, a battery and a cable for connecting the headpiece to the battery through a manually operated switch in the headpiece to selectively energize incandescent lamp means therein, said battery containing rechargeable cell groups and at its upper side presenting a detachable battery top occurring in spaced relation above the rechargeable cell groups to define a space of limited extent, adjustable switching means mounted in the battery top and extending into the said space of limited extent, electrical circuit means including electrical contacts engageable by the switching means in one position of adjustment thereof to provide for operating the cell groups in series, said rechargeable cell groups including two cell groups in which the number of cells in each group is equal, said adjustable switching means being movable into engagement with additional contact means in the electrical circuit means such that the cell groups are operated in parallel to energize the lamp means at a relatively lower level of light intensity, said electrical circuit means further including means by which the current delivered to the lamp means by the cell groups during parallel operation is established at a value appreciably exceeding one-half of the current delivered to the lamp means by the cell groups during series operation.

3. The invention of claim 2 in which the said means by which current is delivered during parallel operation at a value appreciably exceeding one-half the current delivered during series operation is characterized by a voltage reduction of approximately fifty percent.

4. The invention of claim 2 in which the ratio of current delivered to the lamp means during parallel operation to the current delivered to the lamp means during series operation is in a range of 0.7 to 0.9.

5. The invention of claim 2 in which the ratio of wattage drawn by the lamp means during parallel operation to the wattage drawn by the lamp means during series operation is in a range of 0.35 to 0.45.

6. The invention of claim 2 in which the adjustable switching means includes an actuator part which extends through an opening in the battery top and an auxiliary actuator part located externally of the battery top and being engaged with the said actuator part, said auxiliary actuator part being supported in sealing relationship to the upper side of the battery top during its movement.

7. The invention of claim 2 in which the adjustable switching means includes an actuator part which extends through an opening in the battery top and an auxiliary actuator part located externally of the battery top which is engaged with the actuator part, and said auxiliary actuator part including at its under side resilient sealing means.

8. The invention of claim 2 in which the switching means includes means for connecting the cell groups in parallel arrangement such that the battery may be discharged but not recharged and means for connecting the cell groups in series arrangement such that the battery may be recharged but not discharged and said switching means further including means for connecting the cell groups in series arrangement such that the battery may be discharged but not recharged.

9. The invention of claim 2 in which the adjustable switch means is operable to connect the cell groups such that the battery may be discharged but not recharged with the cell groups in parallel arrangement, and the switching means further being operable to connect the cell groups such that the battery may be discharged and recharged with the cell groups in series arrangement.

10. The invention of claim 2 in which the adjustable switch means comprises a slide switch having a switch actuator which extends through the battery top, auxiliary actuator means overlying the battery top and loosely enclosing that portion of the switch actuator which extends through the battery top, said auxiliary actuator means including a recessed portion in which the protruding end of the switch actuator is loosely received.

11. The invention of claim 2 in which the adjustable switch means comprises a slide switch having a switch actuator which extends through the battery top, auxiliary actuator means overlying the battery top and loosely enclosing that portion of the switch actuator which extends through the battery top, said auxiliary actuator means including a recessed portion in which the protruding end of the switch actuator is loosely received, said auxiliary actuator means being slidably held against the top surface of the battery top by guide rail portions fixed to the surface of the battery top.

12. The invention of claim 11 in which the auxiliary actuator means further includes sealing means, said sealing means being maintained in a compressed state by pressure exerted against the auxiliary actuator means by the guide rail portions.

13. The invention of claim 12 in which the auxiliary actuator means includes a recessed portion at its under side in which is received a sealing ring.

* * * * *